US006527168B1

(12) United States Patent
Robinson

(10) Patent No.: US 6,527,168 B1
(45) **Date of Patent: *Mar. 4, 2003**

(54) STACKABLE AND READILY SEPARABLE CARTON BLANK WITH EASE OF ASSEMBLY FEATURES

(75) Inventor: Paul G. Robinson, Cape Elizabeth, ME (US)

(73) Assignee: Mafcote Industries, Inc., Norwalk, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 986 days.

(21) Appl. No.: 08/699,572

(22) Filed: Aug. 19, 1996

(51) Int. Cl.[7] ..... B65D 5/00
(52) U.S. Cl. ..... 229/182; 229/136; 229/917
(58) Field of Search ..... 229/136, 137, 229/182, 186, 190, 917

(56) References Cited

U.S. PATENT DOCUMENTS

| | | | | |
|---|---|---|---|---|
| 2,072,371 A | * | 3/1937 | Kaplan | 229/917 X |
| 2,998,180 A | * | 8/1961 | Dehoney, Jr. | 229/136 |
| 3,201,025 A | * | 8/1965 | Wolowicz et al. | 229/182 |
| 3,306,521 A | * | 2/1967 | Giacovas | 229/136 |
| 3,620,435 A | * | 11/1971 | Sogi | 229/3.5 R |
| 4,289,267 A | | 9/1981 | Mayea | |
| 4,313,556 A | | 2/1982 | Boyle et al. | |
| 4,509,640 A | | 4/1985 | Joyce | |
| 4,549,690 A | | 10/1985 | Rosenburg | |
| 4,767,051 A | | 8/1988 | Single | |
| 4,828,164 A | | 5/1989 | Passamoni | |
| 4,917,289 A | | 4/1990 | Linnemann et al. | |
| 5,009,362 A | | 4/1991 | Brangle, Jr. | |
| 5,011,071 A | | 4/1991 | Lopez | |
| 5,062,527 A | | 11/1991 | Westerman | |
| 5,074,460 A | | 12/1991 | Hanekamp | |
| 5,098,014 A | | 3/1992 | Perkins | |
| 5,161,732 A | | 11/1992 | Clein et al. | |
| 5,183,200 A | | 2/1993 | Okamoto | |

* cited by examiner

*Primary Examiner*—Steven Pollard
(74) *Attorney, Agent, or Firm*—Ware, Fressola, Van Der Sluys & Adolphson LLP

(57) ABSTRACT

Blanks for forming open sided containers and mating covers from carton stock material include strips of non-stick material secured to the blank by means of a strippable adhesive. The adhesive adheres to the carton stock material with a substantially higher adherence force than the adherence force between the adhesive and the non-stick material, so that the non-stick material can be removed, readily, to expose the tacky surface of the adhesive. The carton blanks are marked with a predetermined pattern of fold or crease lines which allows the blank to be bent and folded into the shape of a container or a container cover. The non-stick material facilitates handling and separation of individual blanks that have been shipped and stored in tightly packed, stacked arrays, while the exposed adhesive surface engages specifically formed tabs and/or flaps of the blank in overlapping, abutting relationships to secure the blank in its final, assembled, container/cover shape.

15 Claims, 3 Drawing Sheets

STACKABLE AND READILY SEPARABLE CARTON BLANK WITH EASE OF ASSEMBLY FEATURES

FIELD OF THE INVENTION

This invention relates generally to blanks formed of cardboard or similar carton stock material that can be assembled readily into packages and containers for various goods, and more particularly relates to improvements that facilitate handling, assembly and use of such blanks.

Carton blanks, of the type comprising a unitary flat sheet of cardboard carton stock having various pre-marked lines formed thereon in a predetermined pattern that allows the blank to be bent and/or folded from its planar flat stage into a three-dimensional structure having the shape of a carton or box-like container, are well-known. It is also well known that the same carton shape, having a slightly different shape and/or different dimensions can be provided to serve as a telescopically engageable lid or cover for open-sided carton containers of the type herein described. The terms carton, container and the like, as used in this specification, should be understood as being used interchangeably and collectively to identify both containers and/or covers. In this art, flat carton blanks are commonly identified by the initials or monogram, KDF, derived from the first letters of the words in the identifying phrase, "knocked down flat".

KDF blanks characterized by pre-defined patterns of crease and/or fold lines that permit the blank to be bent and folded readily into a three-dimensional structure having the shape of a container with three or more upright sidewalls surrounding a base portion, have been known and used for many years. Such blanks frequently include various forms of tabs and flaps that can be brought into overlapping relationship and then secured together so as to retain the desired finished shape. In the prior art, the overlapping tabs and flaps of KDF blanks have been fastened together mechanically as by staples, and by applying liquid adhesives to one or both of two appropriate opposed abutting surface portions, and then allowing the adhesive to "set" so as to assure that the surfaces are attached to each other. Proper application of the adhesive, to assure both correct positioning of the adhesive on the respective overlapping portions, and controlled application of the proper quantity of adhesive for proper fastening strength, is a difficult and labor-intensive process that cannot be performed readily or conveniently in the field.

As an alternative to field assembly, it is known that KDF blanks can be formed and then assembled in a manufacturing plant under carefully controlled conditions, so that completely formed and assembled containers and mating covers can be shipped to end users in finished form, ready to be used without further handling other than packing and closing. However, this method of selling and distributing containers for goods has the serious disadvantage of adding substantial expense to the final cost of the finished product, because the containers generally cannot be nested or otherwise compressed in volume for shipping. As a direct result of the difference between the volume occupied by a stack containing a given number of container blanks and the volume occupied by an equal number of assembled containers, shipping costs for a given quantity of assembled containers are substantially higher than for the same quantity of blanks.

Another problem represented by the prior art technology of KDF containers relates to storage and handling of the flat blanks from which containers are formed. It is common in this art to print information and/or designs on the side of the KDF blank that will form the outer surface of the assembled container. The characteristics of the printing materials, such as inks, that are widely used for this purpose are such that the blanks tend to stick to each other when they are stacked in tiered relationship after they have been printed. Separating stored blanks that have become stuck together often requires additional time and effort in handling, and the separation process may result in the loss of any number of blanks due to damage caused by adhesion, all of which can add significant cost to the final product.

Still further, and independently of the adhesion caused by the printing materials, it is known that the accumulated weight of a stack of tiered blanks can cause compression that is sufficient to exclude all or substantially all of the air from between the abutting surfaces of adjacent blanks; exclusion of air in this manner can result in the formation of a vacuum that has the effect of sealing of adjacent, abutting blanks to each other. A vacuum formed in this manner can have the effect of slowing the processing of individual blanks because of the time and significant effort that may be required to "break" the vacuum so that adjoining blanks can be separated from each other.

Although clinging together of adjacent blanks caused either by printing materials or by vacuum sealing usually can be overcome by manual handling of the blanks, the required time and labor tend to add significant cost to the final product. Any increase in cost, however slight, can have a serious adverse effect on the success of a product in an industry such as this, where cost is a particularly important element of commercial success.

SUMMARY OF THE INVENTION

Accordingly, it is an object of this invention to provide an improved container blank that can be shipped as a blank singly or in stacked bundles and can be assembled easily, conveniently and accurately in the field.

It is another object of this invention to provide a container blank that can be fastened together easily in final form without requiring the use of mechanical fasteners or handling of liquid adhesives.

It is still another object of this invention to provide a KDF container blank that can be separated easily and conveniently when blanks are stored in closely packed stacked relationship.

These and other and further objects, features and advantages of this invention will be made apparent to those having skill in this art by reference to the following specification in the context of the accompanying drawings, in which:

DETAILED DESCRIPTION OF THE INVENTION

Figure 1:
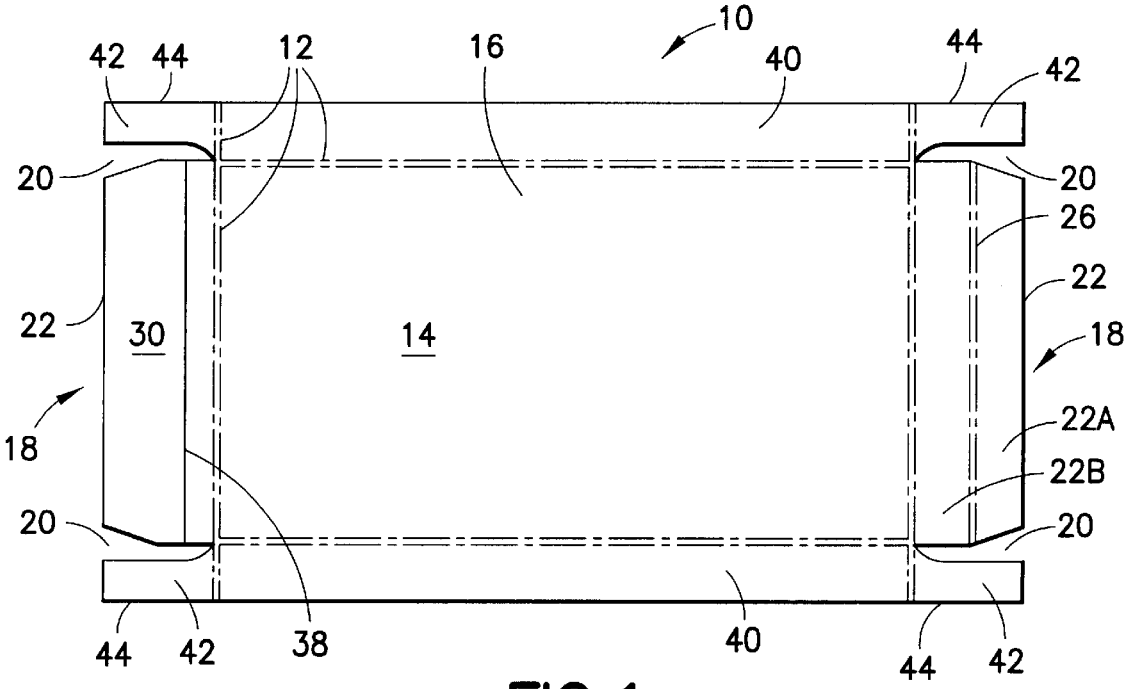
FIG. 1 is a plan view of a first embodiment of a blank in accordance with this invention.

Referring now more specifically to the drawings, FIG. 1 may be seen to represent a blank 10 of predetermined shape, having a plurality of fold lines 12 formed on its surface 14 in a predetermined pattern. Fold lines 12 are formed in any known manner so as to allow the parts of blank 10 that are adjacent to the lines to fold or bend in a generally upward direction relative to the central planar portion 16 of blank 10. As will be made evident by the following description, when blank 10 has been bent and folded into its fully assembled position, surface 14 of the blank will correspond generally to the inner surface of the assembled container, while the opposite side (not shown) of blank 10 will correspond to the outer surface of the container. Central planar portion 16 can be considered to remain generally in or parallel to the plane of the drawing, while the various parts of the blank, to be described below, are folded upwardly relative to portion 16.

At the spaced-apart opposite edges 18 of the blank 10, the predetermined shape of the blank includes a pair of spaced-apart slits 20 that extend inwardly from each of edges 18 to define a central tab or flap 22 and a pair of spaced apart tabs or flaps 42, 42 extending in a generally longitudinal direction on either side of central tab 22. Each one of central flaps 22, at each end of blank 10, includes a transversely extending fold line 26 that divides the flap substantially in half, into sub-portions 22A and 22B. In FIG. 1, fold line 26 on one of flaps 22 is shown hidden by a cover element 30 in accordance with this invention.

Cover element 30, in accordance with this invention is a strip of non-stick material such as polypropylene coated paper having an exposed non-stick surface thereon. In this preferred embodiment of the invention, cover element 30 is secured to blank 10 by a strippable adhesive interposed between one surface of cover element 30 and the opposed, abutting surface of blank 10. The characteristics of the adhesive are such that cover 30 may be stripped away after the adhesive has been adhered to the underlying surface of blank 10, thereby exposing a tacky surface 32 of the adhesive, while the adhesive remains adhered to the underlying surface of blank 10.

Figure 2:
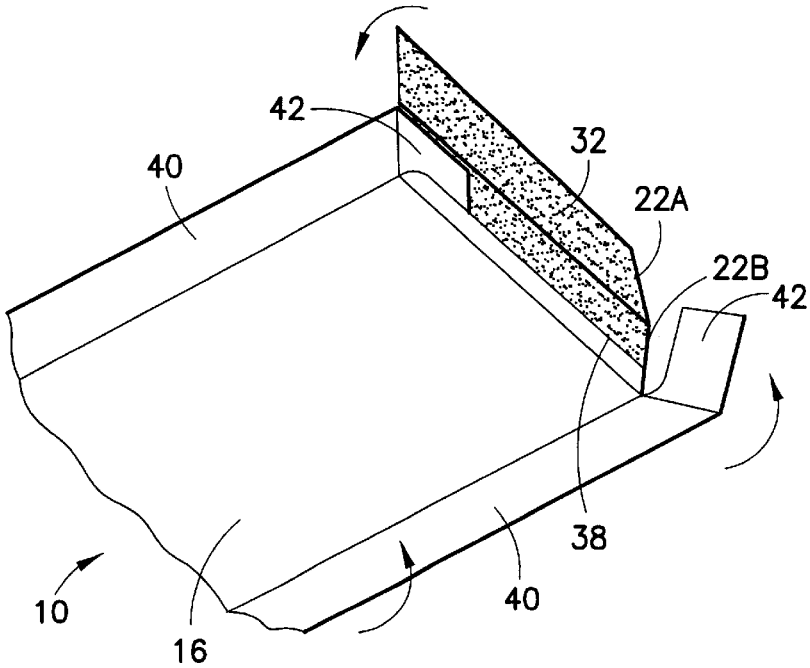
FIG. 2 is a partial pictorial representation of a partially assembled container formed from the blank of FIG. 1.

In FIG. 2, the exposed surface 32 of the adhesive, with cover strip 30 removed, is illustrated as a shaded area on the surface of one of central flap member 22, but it should be understood that both of flap portions 22 will have a similarly disposed adhesive surfaces thereon. A suitable adhesive for the purposes of this invention is a high-tack synthetic rubber-based material having a holding force when adhered to carton stock, of approximately 130 oz/in$^2$. The holding force between the surface of the adhesive and the surface of the strippable cover strip 30 is substantially less than the holding force between the adhesive and the carton stock, to assure that the strip 30 will separate readily from the adhesive while the adhesive remains adhered to the carton stock surface of the blank. Such an adhesive is available in strip form together with a suitable coated paper backing from the 3M Company, as adhesive product No. 475.

In accordance with this invention, the non-stick strip 30 serves two purposes: (1) when the strip is removed to expose the underlying adhesive 32, the adhesive is available to fasten together any overlapping portion of the blank which is deliberately brought into contact with it; and (2) before the strip is removed, and while the blank to which it is attached remains in closely abutting relationship with adjoining blanks in a stack, the strip serves as a non-stick interface between the inner surface 14 of one blank and the opposite surface (not shown) of an adjoining blank in a stack.

Referring again to FIGS. 1 and 2 of the drawings, it can now be seen that flaps 22 can be folded back upon themselves along fold line 26, so that the exposed surface 32 of the adhesive will secure the two portions of the flap 22A and 22B together in overlapping, abutting relationship. As shown clearly in FIG. 2, blank 10 is assembled into a three-dimensional five-sided container shape, having a base surrounded by four upstanding sidewalls, by bending or folding the spaced apart longitudinal side rail portions 40 upwardly at right angles to central body portion 16 of blank 10, and bending tabs 42 at each end of rails 40 at right angles to the rails. Flaps 22 similarly are folded upwardly relative to central body portion 16, so that flaps 42 may be brought into overlapping, abutting relationship with the inner surface of flaps 22. These parts are dimensioned relative to each other so that fold lines 26 on flaps 22 coincide generally with the outer edge 44 of each of flaps 42 when the flaps are brought together in overlapping relationship; the adhesive surface 32 covering part of innermost flap portion 22B serves to retain flap 42 conveniently in position relative to flap 22, while final assembly of the blank is being completed. Final assembly of the blank begins in effect when each one of rails 40 and flaps 22 has been folded into upright relationship relative to central portion 16 of blank 10 and each one of flaps 42 has been brought into overlapping abutting relationship with the inner surface of flaps 22. Final assembly is completed by folding flap portion 22B over and against the corresponding flap portion 22A, thereby capturing flap portions 42 in fixed position sandwiched between flap portions 22A and 22B of one or more capturing flaps 22. The adhesive on the inner surface of flap portion 22A, positioned along the outermost edge 18 of that flap portion, acts to secure it firmly to the abutting surface of flap portion 22B, to complete the "sandwich" and to assure that flaps 42 remain captured between the overlapping abutting parts of flap 22.

Accordingly, flaps 22 may be designated the capturing flaps, while flaps 42 may be designated, correspondingly, the captured flaps. Flaps 42 are further secured in position by contact with any adhesive on flap 22B. Depending upon the desired final shape of the container, any number of captured flaps may be used in combination with any number of capturing flaps to complete the assembly, in accordance with this invention.

Although the predetermined shape of blank 10 in this preferred embodiment is shown to include slits 20 which help to define flaps 42, it will be apparent to those skilled in this art that other forms of blank shapes, such as those having "bellows" form corner flap structures, may be adapted readily to incorporate the features of the invention herein disclosed.

Figure 4:
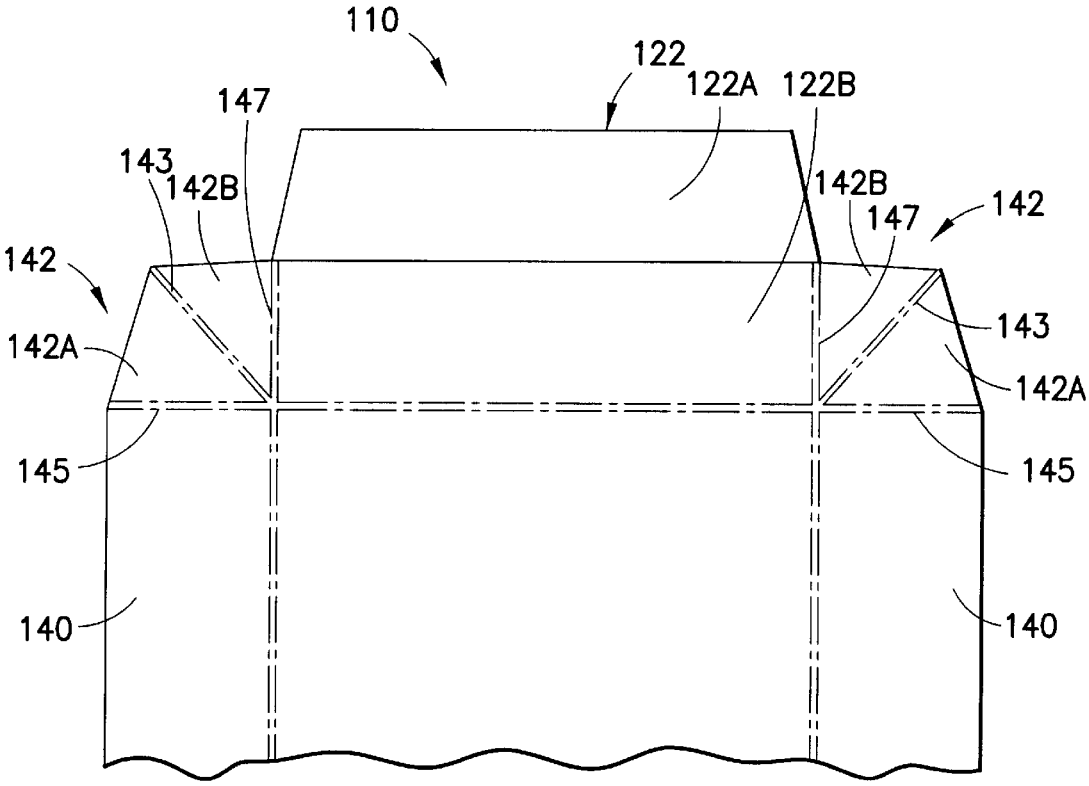
FIG. 4 is a partial plan view of a second embodiment of a blank in accordance with this invention.
Figure 5:
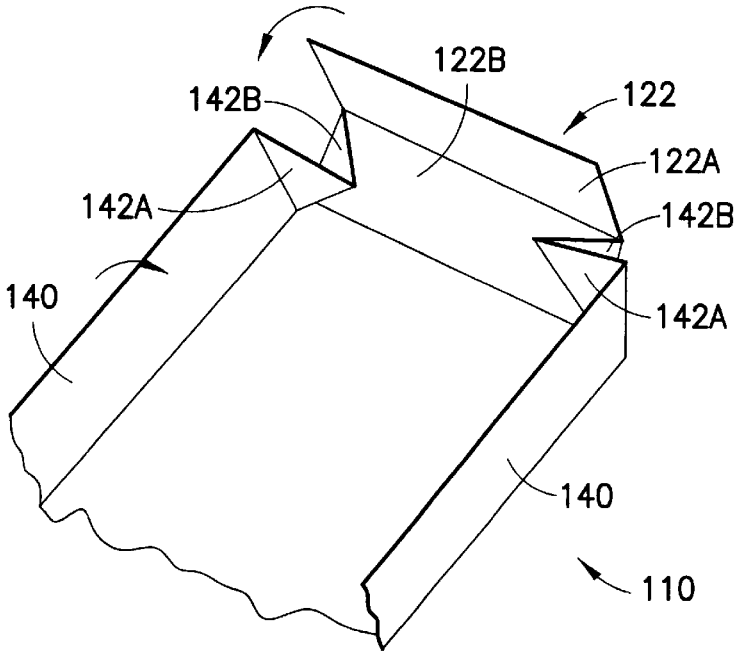
FIG. 5 is a partial pictorial representation of a partially assembled container formed from the blank of FIG. 4.

FIGS. 4 and 5 illustrate an embodiment of this invention in the form of a carton blank 110 incorporating a bellows corner construction for coupling a pair of longitudinal side rails 140 to a capturing flap 122 having a first portion 122B and a second portion 122A that is foldable over the first portion in the same manner as portions 22B and 22A, shown in the embodiment of FIGS. 1 and 2. The two side rails 140 and capturing flap 122, will together, define three upright side walls around base portion 116 of blank 110, to form part of a container or a container cover in accordance with this invention. The bellows corner construction incorporates a bellows corner flap 142 having first and second captured flap portions 142A and 142B that are integrally connected to each other along fold line 143, and are also integrally connected, one to the end of side rail 140 along fold line 145 in the manner of captured flaps 42 shown in FIGS. 1 and 2, and the other to capturing flap 122 along fold line 147. That is, in this embodiment, flap 142 includes first and second fold lines 145 and 147 that intersect each other at an angle and a third fold line 143 that extends from the intersection of fold lines 145, 147 at an angle that substantially bisects the angle defined by lines 145 and 147, so that flap portions 142A and 142B can be folded back upon each other to bring lines 145 and 147 into substantially parallel adjacent relationship to define an upright corner of the desired container shape. It will be understood readily that each of these first, second and third fold lines comprises part of the overall pattern of fold lines that forms part of blank 110.

A principal difference between the corner construction illustrated in the embodiment of FIGS. 1 and 2 and the bellows corner construction illustrated here, in FIGS. 4 and 5, resides in the existence of integrally connected captured flap element 142B. Those having skill in this art will recognize that a principal advantage of the bellows corner construction, shown in the process of assembly in FIG. 5, is that the integral coupling of captured flap element 142B to capturing flap 122, avoids the exposure of a cut edge of carton stock material at the corner that is formed by capturing flap portion 122B and the end of side rail 140 when the carton blank is fully assembled in carton shape. Instead of a cut edge, capturing flap portion 122B exposes the folded-over edge where captured flap element 142B is integrally joined to capturing flap portion 122B. The resulting corners formed by sandwiching captured flap elements 142A and 142B between the adhered-together first and second capturing flap portions 122A and 122B, are substantially the same as the corners described above with reference to FIGS. 1 and 2, except that two layers of carton stock, representing flap elements 142A and 142B are captured between capturing flap portions 122A and 122B at the end of each side rail 140, instead of just one layer, representing captured flap 42 alone, as in the embodiment of FIGS. 1 and 2.

Figure 3:
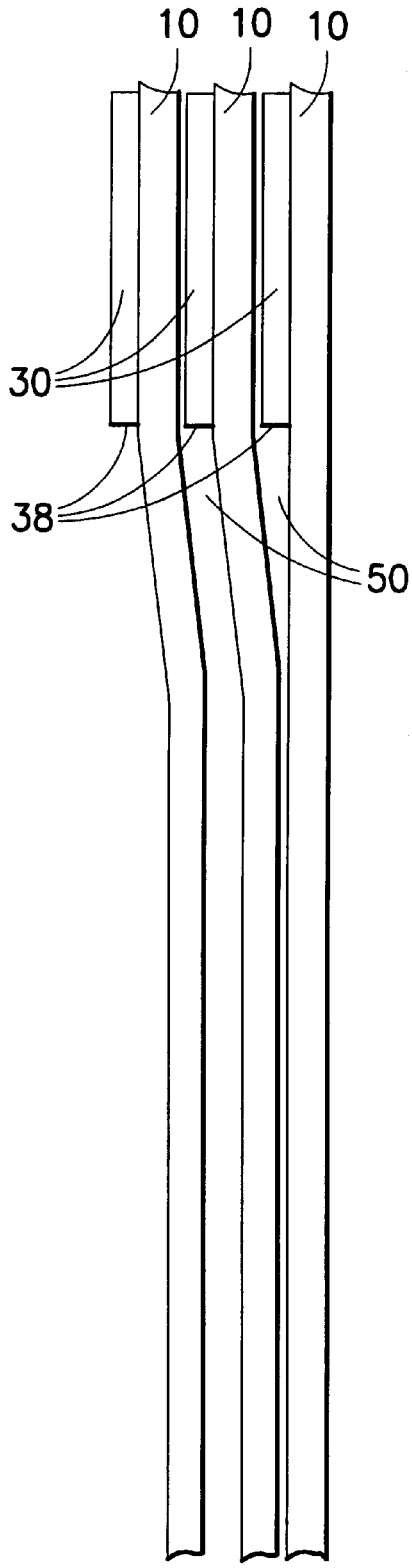
FIG. 3 is a partial side elevation detail view illustrating how blanks constructed in accordance with this invention interact in a stacked array.

As illustrated in FIG. 3, the edge 38 of each non-stick strip 30 creates a slight discontinuity on the inner surface of each blank arrayed in a stack, due to the finite thickness of the strip, which may be on the order of 9 mils. The irregularity creates a small void or air passage 50 between any two closely abutted surfaces of adjoining blanks in the vicinity of the edge of the strip, so as to help break any vacuum formed therebetween, and to facilitate separation of the adjoining blanks. Similarly, the non-stick characteristics of strip 30 effectively preclude adhesion of adjoining blanks in the surface area covered by the strip, thereby further facilitating convenient separation of adjoining blanks by the simple expedient of, for example, manually prying the two blanks apart in the immediate vicinity of the non stick strips. Although other areas of the stacked blanks may nevertheless stick together, areas such as these adjacent to two spaced apart edges of the blank, where adhesion is precluded effectively, provide an efficient and effective mechanism for facilitating separation of clinging/adhering blanks. It has been found that the total surface area of the adhesive used in accordance with this invention, which is substantially the same as the total surface area of the non-stick strip covering the adhesive, desirably will be within the range of between 2% and 30% of the total surface area of the blank, and preferably within the range of 2% and 15%.

The specification and drawings herein set forth clearly and fully describe preferred embodiments of this invention, but it should be readily apparent to those having skill in this art that other forms, embodiments and variations thereof may be conceived and constructed without departing from the spirit and scope of the following claims.

I claim:

1. A knocked-down flat container blank comprising:

a substantially flat blank of carton stock material having a shape;

said blank having a pattern of fold lines formed thereon;

said pattern of fold lines being configured to define with said shape, at least one captured flap and at least one capturing flap foldable and alignable in layered overlapping relationship wherein said capturing flap is configured for capturing at least one thickness of carton stock of said captured flap in a sandwich-like relationship between two thicknesses of carton stock of said capturing flap when said blank is fully assembled in the form of a three-dimensional structure have a container shape;

an elongated generally rectangular portion of the surface area of said capturing flap, proximate a distal edge of said capturing flap, having a separable strip of non-stick material adhered thereto, said strip having a finite thickness;

said separable strip being adhered to said portion of the said surface area on said capturing flap portion by an adhesive contacting both of said capturing flap portion of said blank of carton stock material and said separable strip in an elongated generally rectangular area coextensive with said strip, and characterized by a greater adherence force between said adhesive and the carton stock material of said blank than the adherence force between said adhesive and the surface of said strip of non-stick material, and wherein said adhesive and said strip are applied only to the capturing flap of the capturing and captured flaps.

2. A knocked-down flat container blank in accordance with claim 1, wherein:

the aggregate total surface area of said blank occupied by said adhesive comprises not less than 2% of the total surface area of one side of said blank.

3. A knocked-down flat container blank in accordance with claim 1, wherein:

the aggregate total surface area of said blank occupied by said adhesive comprises not substantially more than 30% of the total surface area of one side of said blank.

4. A knocked-down flat container blank in accordance with claim 1, wherein:

the value of the unit force of adherence between said adhesive and said separable strip of non-stick material is less that the value of the unit force of adherence between said adhesive and the carton stock with which it comes in contact.

5. A knocked-down flat container blank in accordance with claim 1, wherein:

said adhesive comprises a synthetic rubber resin-based material.

6. A knocked-down flat container blank in accordance with claim 1, wherein:

said capturing flap includes a transversely extending fold line forming part of said pattern of fold lines, defining two parallel portions of said capturing flap foldable about said transversely extending fold line to overlap each other in parallel abutting relationship for capturing said captured flap therebetween.

7. A knocked-down flat container blank in accordance with claim 6, comprising:

a pair of capturing flaps and two pair of captured flaps, with one of said pairs of captured flaps having both flaps thereof positioned for capture between said parallel portions of one of said pair of capturing flaps, and both flaps of the remaining pair of captured flaps being positioned for capture between the said parallel portions of the other of said pair of capturing flaps.

8. A knocked-down flat container blank in accordance with claim 1, wherein:

said captured flap is of the bellows corner type having first and second fold lines intersecting each other at a first angle and having a third fold line extending from the intersection of said first and second fold lines at a second angle that substantially bisects said first angle such that said captured flap is foldable back upon itself to bring said first and second fold lines into substantially parallel adjacent relationship and, said first, second and third fold lines all form part of said pattern of fold lines.

9. A knocked-down flat container blank in accordance with claim 1, wherein:

said separable strip of non-stick material comprises polypropylene coated paper stock.

10. A knocked-down flat container blank in accordance with claim 1, wherein:

said blank has a given total surface area on one side thereof, and the surface area occupied by said adhesive, is within the range of two to thirty percent of the area of said given total surface of area of said blank.

11. A knocked-down flat container blank in accordance with claim 1, wherein:

said blank has a given total surface area on one side thereof, and the surface area occupied by said adhesive, is within the range of two to fifteen percent of the area of said given total surface of area of said blank.

12. A knocked-down flat container blank in accordance with claim 1, wherein:

said shape of said blank is substantially rectangular;

said shape includes a pair of longitudinal side rails extending along the spaced-apart outermost longitudinal edges of said shape, each defined in part by a separate, longitudinally extending fold line forming part of said pattern of fold lines;

said longitudinal side rails each include a first captured flap at one longitudinal end thereof and a second captured flap at the opposite longitudinal end thereof, said first and second captured flaps both being defined in part by a fold forming part of said pattern of fold lines and extending transversely across said side rail so that said captured flaps are foldable about said fold line to extend at right angles to said side rail;

said shape further including a pair of capturing flaps extending transversely across the length of said blank between said longitudinal side rails at longitudinally opposite ends of said blank, said capturing flaps being discontinuous with said captured flaps; said capturing flaps each including first and second fold lines forming part of said pattern of fold lines and extending transversely across the length of said blank, said second fold line dividing each capturing flap into two sub-portions that are foldable back upon themselves to capture two of said captured flaps between the said two sub-portions of each capturing flap;

each of said capturing flaps having a separable strip of non-stick material adhered thereto proximate the longitudinally outermost transverse edge thereof and said captured flaps not having a separable strip of non-stick material adhered thereto.

13. A knocked-down flat container blank in accordance with claim 1, wherein:

said separable strip of non-stick material forms a surface discontinuity extending to an edge of said capturing flap, whereby when a plurality of blanks of the same shape are stacked in closely abutting relationship, the discontinuity formed by the strips creates an air passage precluding formation of an air vacuum suction lock between abutting blanks.

14. A knocked-down flat container blank in accordance with claim 13, wherein:

the aggregate total surface area of said blank occupied by said adhesive comprises not less than 2% of the total surface area of one side of said blank.

15. A knocked-down flat container blank in accordance with claim 13, wherein:

the aggregate total surface area of said blank occupied by said adhesive comprises not substantially more than 15% of the total surface area of one side of said blank.

* * * * *